US007743687B2

(12) United States Patent
Lu et al.

(10) Patent No.: US 7,743,687 B2
(45) Date of Patent: Jun. 29, 2010

(54) SCREWDRIVER HELPER

(75) Inventors: Li-Chin Lu, Taipei Hsien (TW); Jian-Hua Xiang, Shenzhen (CN); Guan-Wu Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 45 days.

(21) Appl. No.: 12/139,511

(22) Filed: Jun. 16, 2008

(65) Prior Publication Data

US 2008/0313818 A1 Dec. 25, 2008

(30) Foreign Application Priority Data

Jun. 21, 2007 (CN) ..... 2007 1 0200850

(51) Int. Cl.
*B25B 23/00* (2006.01)

(52) U.S. Cl. ..... 81/439; 81/462; 81/451; 81/177.2; 81/180.1

(58) Field of Classification Search ..... 81/44, 81/487, 451, 436, 438, 439, 52, 462, 180.1, 81/488, 58.1–58.4
See application file for complete search history.

(56) References Cited

U.S. PATENT DOCUMENTS 2,621,688 A * 12/1952 Wales ..... 81/436
4,598,614 A * 7/1986 Kipp ..... 81/58.3
5,370,022 A * 12/1994 Rodriguez et al. ..... 81/462
5,462,436 A * 10/1995 Beaty ..... 433/141

* cited by examiner

*Primary Examiner*—D. S Meislin
(74) *Attorney, Agent, or Firm*—Frank R. Niranjan

(57) ABSTRACT

A screwdriver helper includes a handle, a guide, and a bit. The handle defines a through hole therein. The guide is affixed to the handle. The guide comprises a top surface, a bottom surface, and a through guide hole defined between the top surface and the bottom surface. The top surface is faced to the handle. The guide hole is corresponding to the through hole of the handle. An axis of the guide hole is perpendicular to the bottom surface. The bit is positioned in the guide hole. The bit comprises a tip and a head. The tip is in a shape of a screw head. The head defines slots in a top end thereof. The bit is movable along the axis of the through guide hole. The screwdriver helper helps screwdriver to lock screws firmly.

5 Claims, 6 Drawing Sheets

SCREWDRIVER HELPER

BACKGROUND

1. Technical Field

The present invention relates to a screwdriver helper.

2. General Background

Screwdrivers are usually used to insert or remove screws. However, in some cases, the screws cannot be firmly tightened after insertion. For example, referring to FIG. 5, a notebook computer's main body 10 is disclosed. The main body 10 includes a battery case 11. Some holes, such as hole 12, are defined in the walls of the battery case 11, for receiving screws. Referring to FIG. 6, a screwdriver 20 is used to drive a screw 30 into the hole 12. Because of the size of the screwdriver chuck the screwdriver 20 must be tilted to drive the screw 30, thus the threads of the screw 30 or the threads of the hole 12 may strip because the driving force is not along the axis of the hole 12.

Thus, what is needed is a device that is able to insert or remove screws located in awkward positions.

SUMMARY

A kind of screwdriver helper is disclosed. The screwdriver helper includes a handle, a guide, and a bit. The handle defines a through hole therein. The guide is affixed to the handle. The guide comprises a top surface, a bottom surface, and a through guide hole defined between the top surface and the bottom surface. The top surface is facing the handle. The guide hole is corresponding to the through hole of the handle. An axis of the guide hole is perpendicular to the bottom surface. The bit is positioned in the guide hole. The bit comprises a tip and a head. The tip is in a shape of a screw head. The head defines slots in a top end thereof. The bit is movable along the axis of the through guide hole.

Further features and advantages will be provided or will become apparent in the course of the following detailed description.

BRIEF DESCRIPTION OF THE DRAWINGS

The components of the drawings are not necessarily drawn to scale, the emphasis instead being placed upon clearly illustrating the principles of the screwdriver helper. Moreover, in the drawings, like reference numerals designate corresponding parts throughout the several views.

DETAILED DESCRIPTION OF THE EMBODIMENT

Figure 1:
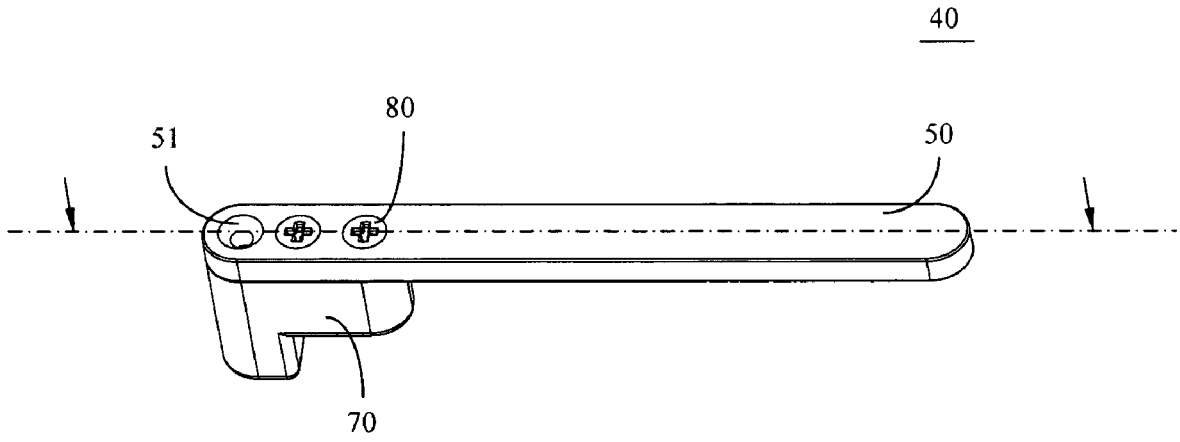
FIG. 1 is an isometric view of a screwdriver helper according to a exemplary embodiment of the present invention.
Figure 2:
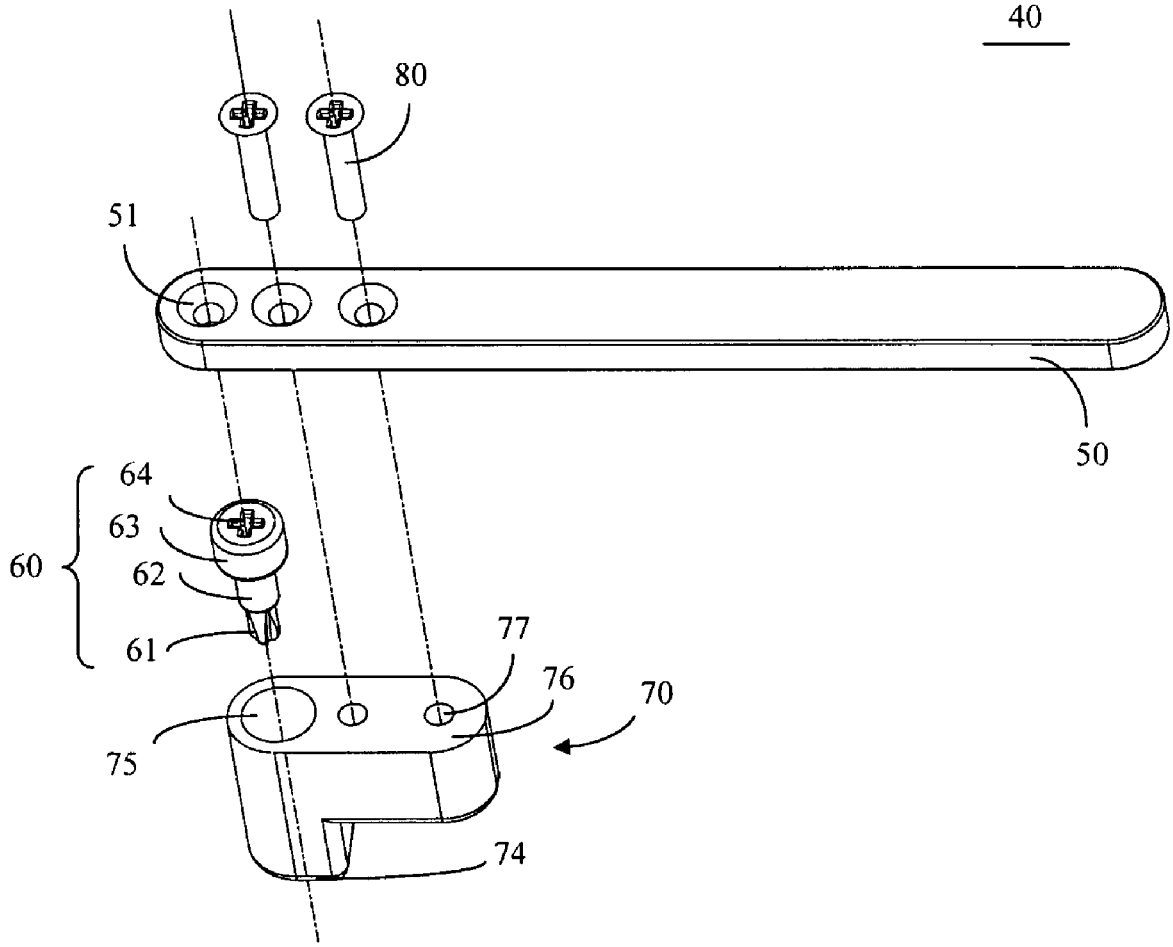
FIG. 2 is an exploded view of the screwdriver helper of FIG. 1.

Referring to FIGS. 1 and 2, a screwdriver helper 40 according to an exemplary embodiment of the present invention is disclosed. The screwdriver helper 40 includes a handle 50, a bit 60, and a guide 70.

Figure 3:
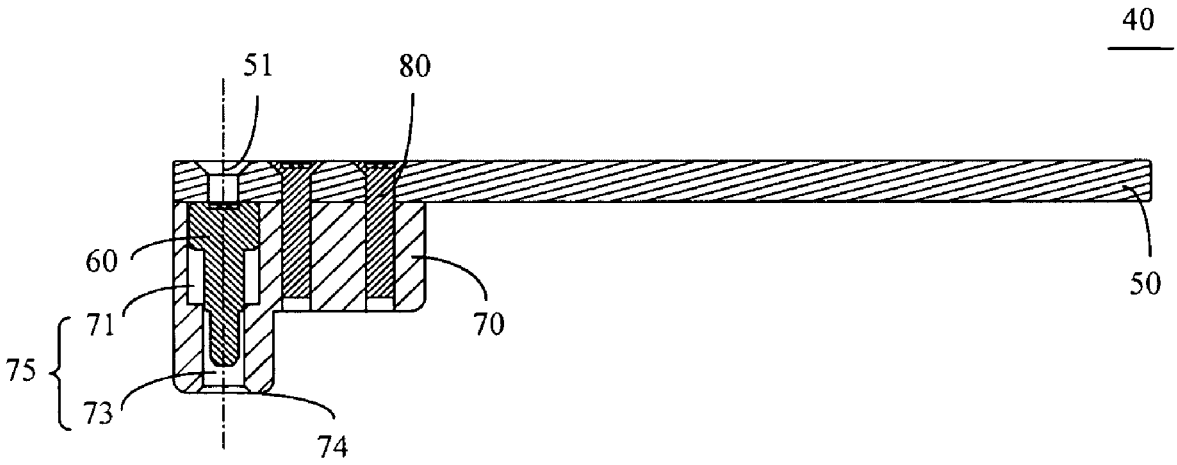
FIG. 3 is a section view of the screwdriver helper of FIG. 1.

Referring to FIGS. 2 and 3, the handle 50 defines three through holes 51.

The guide 70 is L-shaped, and includes a top surface 76 and a bottom surface 74. The top surface 76 faces the handle 50. The guiding hole 75 is defined in the guide 70, corresponding to one of the through holes 51 of the handle 50, between the top surface 76 and the bottom surface 74. An axis of the guiding hole 75 is perpendicular to the top surface 76 and the bottom surface 74. The guiding hole 75 is a stepped hole. That is, the guiding hole 75 includes a large diameter top part 71 and a small diameter bottom part 73. The guide 70 further defines screw holes 77 corresponding to the other two through holes 51 of the handle 50 in the top surface 76.

The bit 60 is magnetic, and includes a tip 61, a shaft 62, and a head 63. The tip 61 is in a shape of a screw head, so as to drive a screw 30 (see FIG. 4). A diameter of the shaft 62 is equal to a diameter of the bottom part 73. A diameter of the head 63 is equal to a diameter of the top part 71 and is larger than a diameter of the through hole 51 of the handle 50. Slots 64 are defined in a top end of the head 63 for cooperating with a head 91 of an electric screwdriver 90 (see FIG. 4).

In assembling the screwdriver helper 40, the tip 61 of the bit 60 faces the bottom surface 74 and put the bit 60 into the guide hole 75 from the top part 71, then screw the screws 80 in the two through holes 51 and the screw holes 77 to connect the handle 50 with the guide 70. Because the diameter of the through hole 51 is smaller than the diameter of the head 63, the bit 60 is confined to the guide hole 75.

In other embodiment, the handle 50 and the guide 70 can be connected by other means, for example, soldering means. Thus, the screws 80, the screw holes 77, and the corresponding two through holes 51 can be removed.

Figure 4:
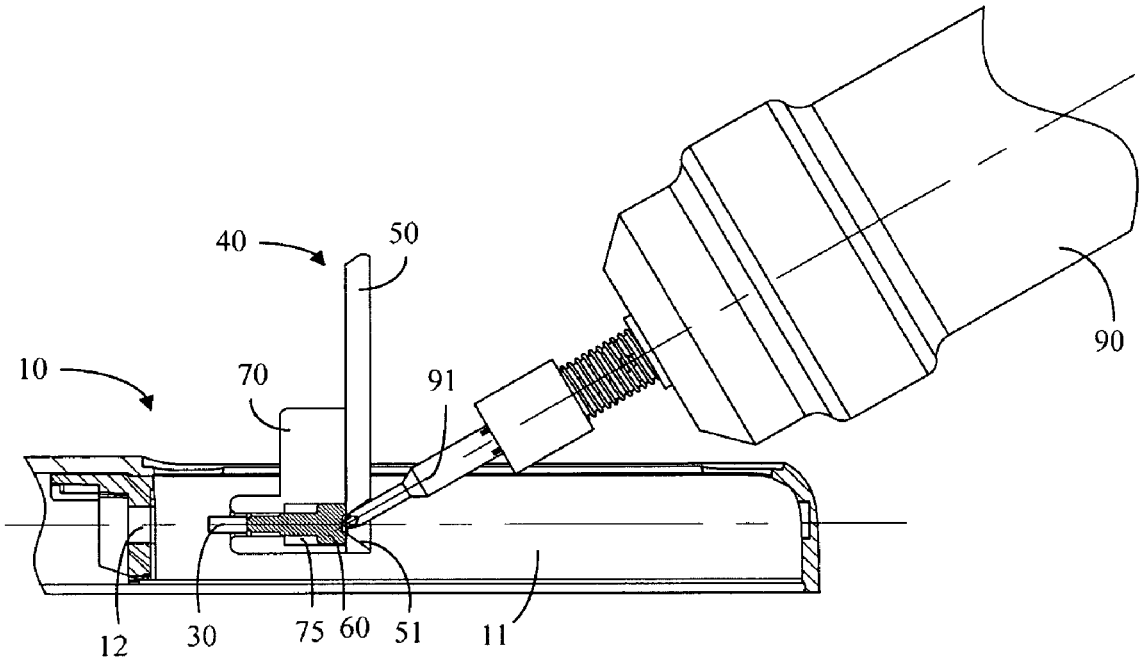
FIG. 4 is a schematic, section view showing a screwdriver and the screwdriver helper of FIG. 1 in use.
Figure 5:
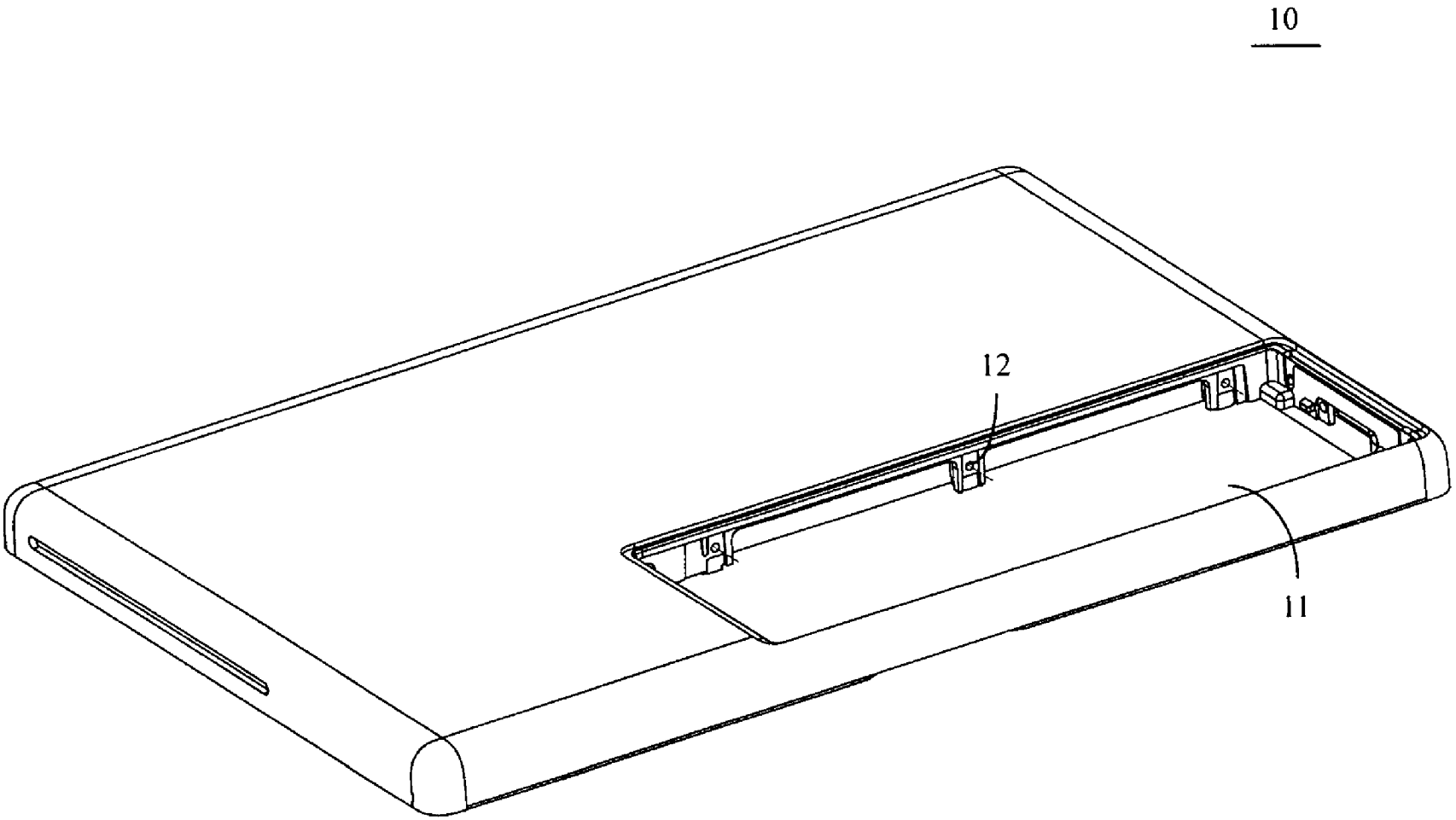
FIG. 5 (Related Art)
FIG. 5 is an isometric view of a main body of a notebook computer.
Figure 6:
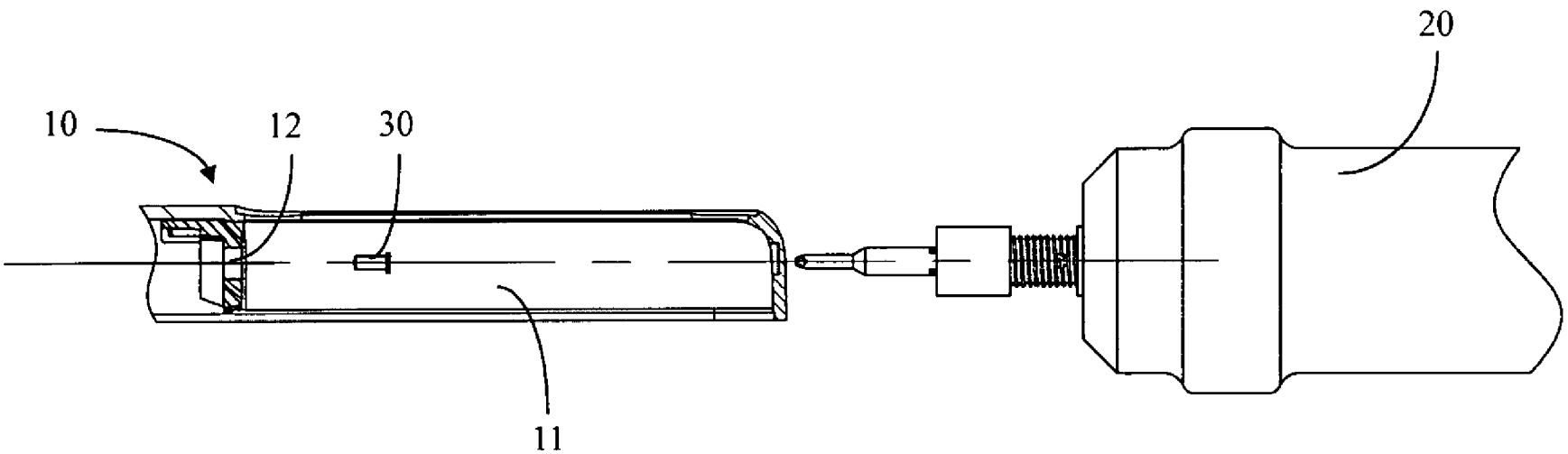
FIG. 6 (Related Art)
FIG. 6 is a schematic, section view showing a screwdriver in place to lock screws in the main body of FIG. 5.

Referring to FIG. 4, to firmly screw the screw 30, first, let the tip 61 of the drive 60 attracts the screw 30 by magnetic force. Second, align the guide hole 75 with the hole 12 so that an axis of the guide hole 75 coincides with an axis of the hole 12. Third, let the head 91 of the screwdriver 90 plug into the through hole 51 of the handle 50 and cooperate with the head 63 of the bit 60. Lastly, use the screwdriver 90 to drive the bit 60, and in turn the bit 60 will drive the screw 30 in the hole 12 correspondingly. Whether the screwdriver 90 is tilted, or not tilted, relative to the axis of the hole 12, the bit 60 will move along the axis of the guide hole 75, thus, the screw 30 is firmly screwed in the hole 12.

It is to be understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A screwdriver helper comprising:

a handle with a through hole defined therein;

a guide affixed to the handle, the guide comprising:

a top surface facing the handle;

a bottom surface; and a through guide hole, corresponding to the through hole of the handle, being defined between the top surface and the bottom surface, wherein an axis of the through guide hole is perpendicular to the bottom surface, and the through guide hole is a stepped hole comprising a large diameter top part and a small diameter bottom part; and a bit positioned in the through guide hole, the bit comprising:

a tip in a shape of a screw head; and a head defining slots in a top end thereof, wherein the bit is movable along the axis of the through guide hole.

2. The screwdriver helper of claim 1, wherein a diameter of the head is equal to the large diameter of the top part of the stepped hole.

3. The screwdriver helper of claim 1, wherein the bit further comprises a shaft between the tip and the head, a diameter of the shaft is equal to the small diameter of the bottom part of the stepped hole.

4. The screwdriver helper of claim 1, wherein a diameter of the through hole defined in the handle is smaller than the large diameter of the top part of the stepped hole.

5. The screwdriver helper of claim 1, wherein the bit is magnetic.

* * * * *